US007085519B2

(12) United States Patent
Makino

(10) Patent No.: US 7,085,519 B2
(45) Date of Patent: Aug. 1, 2006

(54) DRIVE TRAIN FOR AN IMAGE FORMING APPARATUS

(75) Inventor: Kazumasa Makino, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/397,162

(22) Filed: Mar. 27, 2003

(65) Prior Publication Data

US 2003/0190172 A1 Oct. 9, 2003

(30) Foreign Application Priority Data

Apr. 3, 2002 (JP) ..... 2002-101542

(51) Int. Cl.
*G03G 15/00* (2006.01)

(52) U.S. Cl. ..... 399/167

(58) Field of Classification Search ..... 399/36, 399/167, 222, 394

See application file for complete search history.

(56) References Cited

U.S. PATENT DOCUMENTS

| | | | | |
|---|---|---|---|---|
| 5,848,333 | A | * 12/1998 | An | 399/167 |
| 6,684,047 | B1 | 1/2004 | Kin et al. | |
| 2003/0185594 | A1 | 10/2003 | Okabe | |

FOREIGN PATENT DOCUMENTS

| | | |
|---|---|---|
| JP | A 01-276151 | 11/1989 |
| JP | A 3-188475 | 8/1991 |
| JP | A 7-203165 | 8/1995 |
| JP | A 8-87225 | 4/1996 |
| JP | A 8-137180 | 5/1996 |
| JP | A 2000-098746 | 4/2000 |
| JP | A 2001-290365 | 10/2001 |
| JP | A 2000-006622 | 1/2002 |

* cited by examiner

*Primary Examiner*—Hoang Ngo
(74) *Attorney, Agent, or Firm*—Oliff & Berridge, PLC

(57) ABSTRACT

The invention addresses the problem of providing a steady drive to the photosensitive drum when all loads are driven from a common motor. To address the issue, the invention includes three drive trains. A first drive train that extends from the drive shaft of the motor to the photosensitive drum; a second drive train that extends from the drive shaft of the motor to the heating mechanism; and a third drive train that extends from the drive shaft of the motor to the toner cassette and drives the toner feed elements contained therein. A first drive element for each of the first and second drive trains is independently rotatably mounted on a common axis. Positioned on substantially an opposite side of the drive shaft is a first drive element of the third drive mechanism. As a result, the forces applied to the drive shaft as reaction forces to driving the various loads are substantially counterbalanced. Further, because the first drive element of each of the first and second drive trains are separate from one another in rotation, the second drive train has no effect on the first drive train driving the photosensitive drum.

18 Claims, 11 Drawing Sheets

150

170

DRIVE TRAIN FOR AN IMAGE FORMING APPARATUS

BACKGROUND OF THE INVENTION

1. Field of Invention

The invention is related to an image forming apparatus for providing stable rotation of an image bearing body.

2. Description of Related Art

Conventionally, in an image forming apparatus using an electrophotographic method, such as a laser printer, a static latent image is formed on a photosensitive drum, and the electrostatic latent image is developed by a developing roller where toner is supplied from a toner supply roller. The developed toner image is transferred to a recording medium and fixed onto the recording medium by applying high temperature thereto by a fixing roller. The recording medium is transported to the photosensitive drum by a recording medium transporting roller.

Therefore, in the image forming apparatus, the photosensitive drum, the developing roller, the toner supply roller, the fixing roller, the recording medium transporting roller and other components are driven by a motor.

Recently, an image forming apparatus having one motor that drives the rollers including the photosensitive drum has been known, as disclosed in Japanese Unexamined Patent Publication No. 8-137180. In this image forming apparatus, a plurality of gears are used for transferring driving force from a motor shaft to the rollers including the photosensitive roller.

SUMMARY OF THE INVENTION

The invention addresses the problem of providing a steady drive to the photosensitive drum when all loads are driven from a common motor. To address the issue, the invention includes three drive trains. A first drive train that extends from the drive shaft of the motor to the photosensitive drum; a second drive train that extends from the drive shaft of the motor to the heating mechanism; and a third drive train that extends from the drive shaft of the motor to the toner cassette and drives the toner feed elements contained therein.

A first drive element for each of the first and second drive trains is independently rotatably mounted on a common axis. Positioned on substantially an opposite side of the drive shaft is a first drive element of the third drive mechanism. As a result, the forces applied to the drive shaft as reaction forces to driving the various loads are substantially counterbalanced. Further, because the first drive element of each of the first and second drive trains are separate from one another in rotation, the second drive train has no effect on the first drive train driving the photosensitive drum.

The first drive elements for each of the first, second and third drive trains are helical gears and engage a gear that is either formed in the drive shaft of the drive motor or a gear fixedly mounted to the drive shaft of the drive motor.

BRIEF DESCRIPTION OF THE DRAWINGS

The invention will be described with reference to the drawings, in which.

DETAILED DESCRIPTION OF PREFERRED EMBODIMENTS

Figure 1:
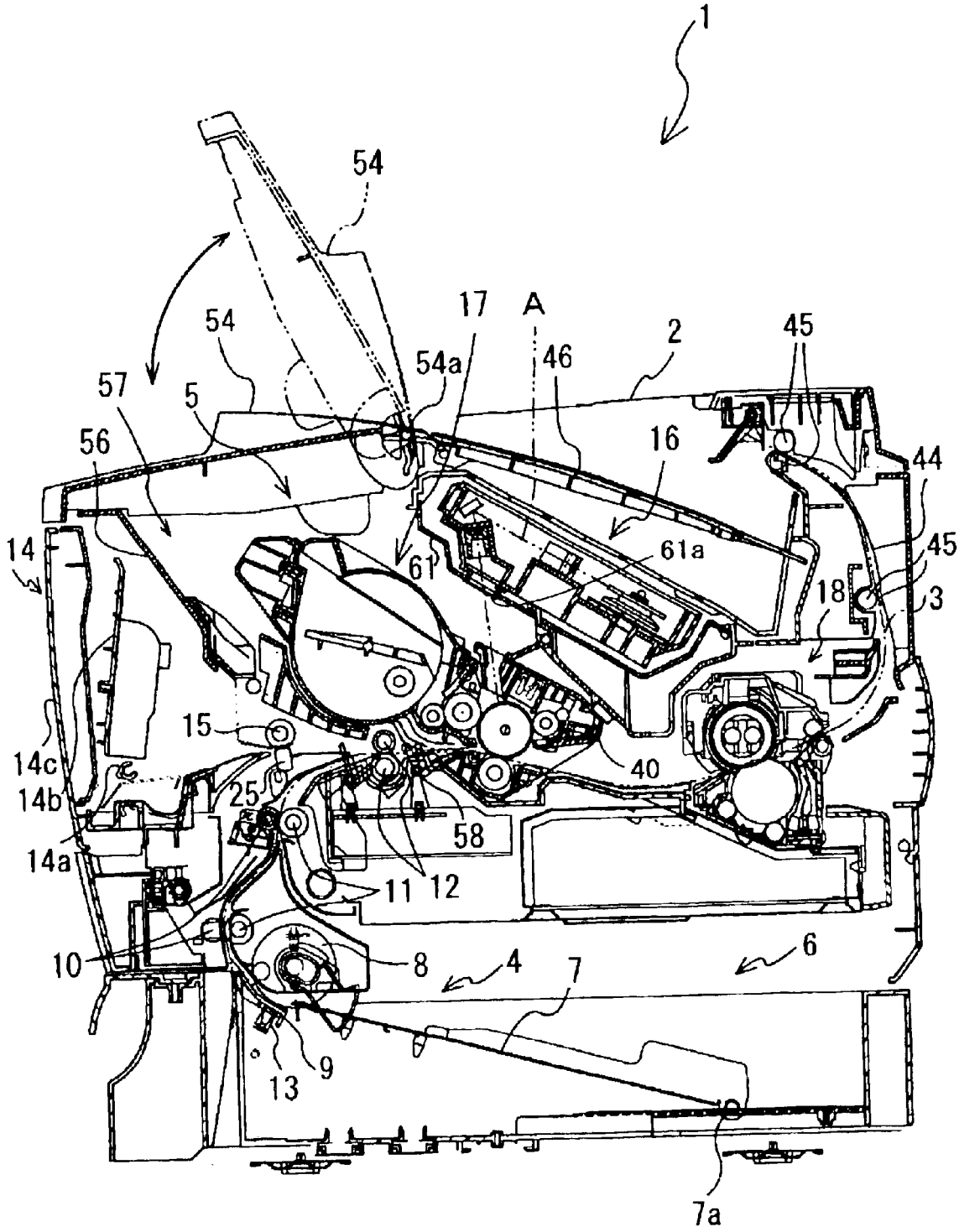
FIG. 1 is a side cross-sectional view of a laser printer.

The structure of a laser printer 1 will be explained with reference to FIG. 1. FIG. 1 is a central cross sectional view of a laser printer of the embodiment. As shown in FIG. 1, the laser printer 1 comprises a casing 2 and in the casing 2, a feeder portion 4 for supplying a paper 3 as a recording medium and an image forming portion 5 for forming a predetermined image onto the supplied paper 3. The left side in FIG. 1 is the front side of the laser printer 1.

A discharge tray 46 is formed in a recess portion at an upper rear side in the casing 2 so as to stack the printed papers 3. A cartridge accommodation portion 57 is arranged at an upper front side in the casing 2. The cartridge accommodation portion 57 is a space when its upper surface is open. A process cartridge 17 is mounted in or removed from the cartridge accommodation portion 57. The cartridge accommodation portion 57 is covered with an upper cover 54 that is rotated up and down around a support shaft 54*a* arranged at a front end of the discharge tray 46. The position of the upper cover 54 when it is open is shown by a double dotted line in FIG. 1.

A discharge path 44 is arranged at a rear side (a right side in FIG. 1) in the casing 2. The discharge path 44 is formed in an arc in an up-down direction along a rear surface of the casing so that a paper 3 is discharged from a fixing device 18 to the discharge tray 46. The fixing device 18 is arranged at a lower rear side in the casing 2 and the discharge tray 46 is arranged at an upper rear side in the casing 2. A discharge roller 45 is arranged on the discharge path 44 for transporting the paper 3.

Because the discharge path 44 is formed in an arc, the paper 3, whose upper surface has a printed image, is discharged onto the discharge tray 46 with its upper surface facing down. This discharge method is called face-down method. When a plurality of papers are printed, the papers 3 are stacked with their printed surfaces facing down in a discharged order and the printed papers 3 are ordered in the printed order.

The feeder portion 4 comprises a supply roller 8, a supply tray 6, a paper pressing plate 7, a separation pad 9, transporting rollers 11, paper powder removing rollers 10 and resist rollers 12. The supply roller 8 is arranged at a bottom in the casing 2. The supply tray 6 is detachably arranged in the casing 2. The paper pressing plate 7 is arranged in the supply tray 6 so as to stack the papers 3 thereon and press the papers 3 to the supply roller 8. The separation pad 9 is arranged at one side end of the supply tray 6 so as to be pressed toward the supply roller 8. The separation pad 9 presses a paper 3 with the supply roller 8 for transporting the paper 3 and preventing more than one paper 3 being fed at a time. The transporting rollers 11 are arranged at two points in a lower stream side of a paper 3 transporting direction with respect to the supply roller 8 for transporting the paper 3. The paper powder removing rollers 10 remove paper powder via the paper 3 by opposing the paper transporting rollers 11 that transport the paper 3 in cooperation with the opposing transporting rollers 11. The resist rollers 12 are arranged downstream in the paper 3 transporting direction with respect to the transporting rollers 11. The resist rollers 12 adjust a timing for feeding a paper 3 during the printing operation.

The paper pressing plate 7 has papers 3 stacked thereon. A support shaft 7*a* of the paper pressing plate 7, arranged at an end away from the paper feeding roller 8, is supported by the bottom surface of the supply tray 6 and the end closest to the paper feeding roller 8 is movable up and down around the support shaft 7*a*. The paper pressing plate 7 is urged toward the paper feeding roller 8 by a spring (not shown) from the rear side of the paper pressing plate 7.

The paper pressing plate 7 is moved downwardly around the support shaft 7*a* against the urging force of the spring as the stacked amount of the papers 3 increases. The supply roller 8 and the separation pad 9 are arranged to face one another. The separation pad 9 is pressed toward the supply roller 8 by a spring 13 arranged at a rear side of the separation pad 9.

A manual tray 14 is arranged at a front surface side (a left side in FIG. 1) of the casing 2. The manual tray 14 comprises a tray 14*b* and a cover 14*c*. The tray 14*b* is open and closed in a front and rear direction (left and right direction in FIG. 1) around a support shaft 14*a*. The tray 14*b* holds stacked papers 3 when opened. The cover 14*c* slides with respect to the tray 14*b* and becomes a part of the casing 2 when the tray 14*b* is closed. A manual roller 15 and a separation pad 25 are arranged in the vicinity of the manual tray 14. The manual roller 15 feeds the papers 3 stacked on the tray 14*b* of the manual tray 14. The separation pad 25 prevents more than one paper 3 being fed at a time.

The manual roller 15 and the separation pad 25 are arranged to face one another and the separation pad 25 is pressed toward the manual roller 15 by a spring (not shown) arranged at a rear side of the separation pad 25. The papers 3 stacked on the manual tray 14 are separated by the separation pad 25 one by one and the separated paper 3 is transported to the resist rollers 12 by the manual roller 15.

Figure 2:
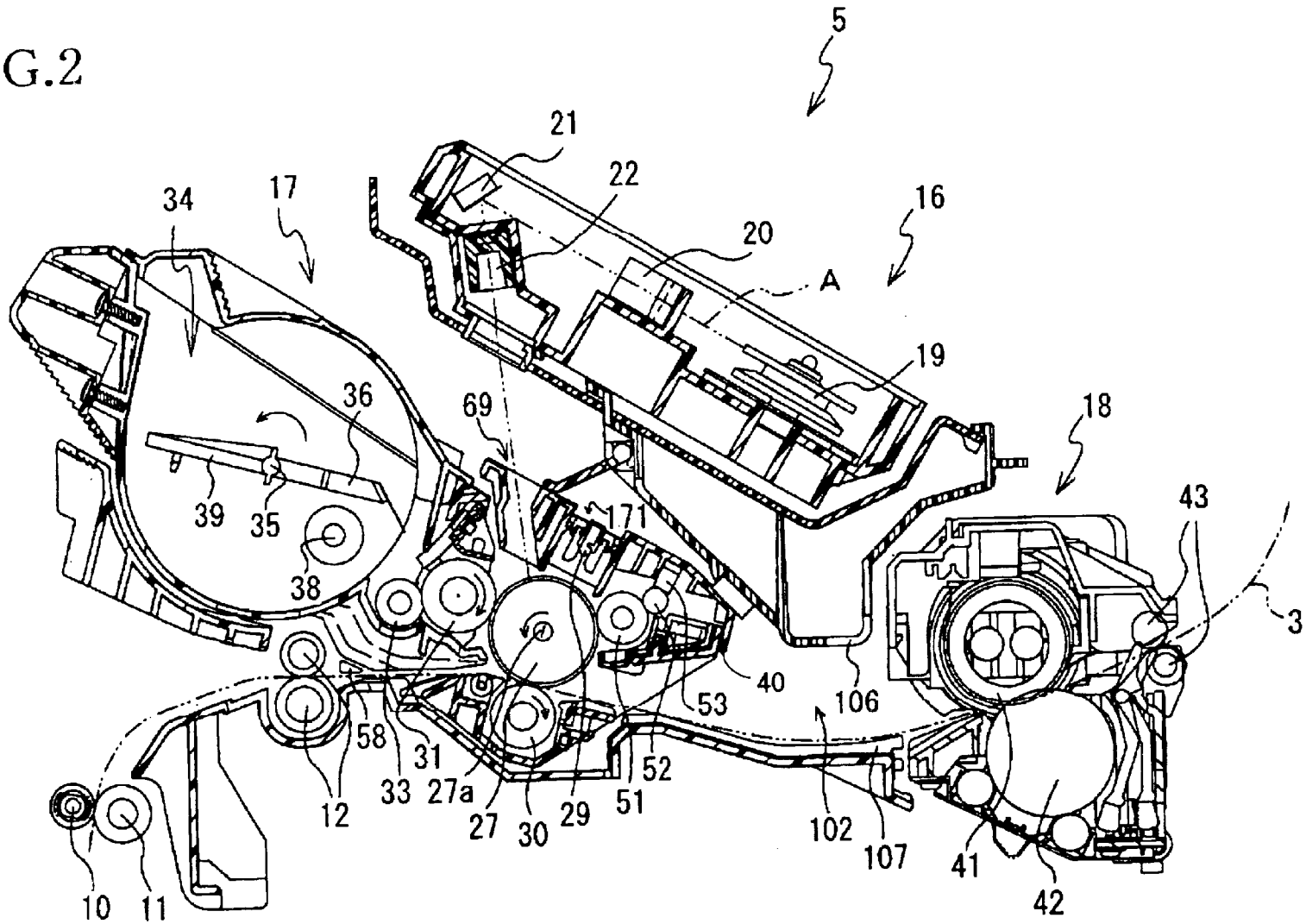
FIG. 2 is a side cross-sectional view of an image forming portion.
Figure 3:
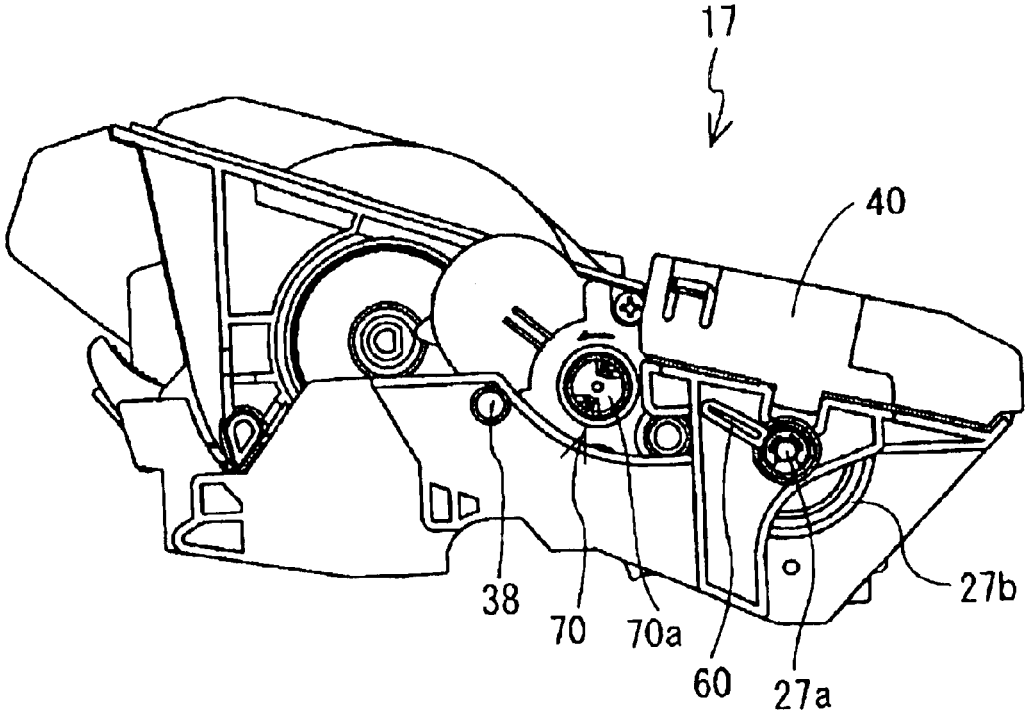
FIG. 3 is a side view of a process cartridge.

The structure of the image forming portion 5 will be explained with reference to FIGS. 2 and 3. FIG. 2 is a cross-sectional view of the image forming portion 5 seen from the side. FIG. 3 is a side view of the process cartridge 17. As shown in FIG. 2, the image forming portion 5 comprises a scanner unit 16, the process cartridge 17 and the fixing device 18 so as to form an image on the paper 3 that is transported by the feeder portion 4.

The scanner unit 16 is arranged at a lower side of the discharge tray 46 in the casing 2. The scanner unit 16 comprises a laser emission portion (not shown), a polygon mirror 19, a fθ lens 20, a reflection mirror 21 and a relay lens 22. The laser emission portion emits a laser beam. The polygon mirror 19 is rotated to scan the laser beam, that is emitted from the laser emission portion, in a main scanning direction. The fθ lens 20 keeps the scanning speed of the laser beam constant. The reflection mirror 21 reflects the scanned laser beam. The relay lens 22 adjusts a focus position so as to form an image on the photosensitive drum 27 by the laser beam reflected by the reflection mirror 21.

The laser beam emitted from the laser emission portion, based on predetermined image data, is passed through or reflected by the polygon mirror 19, the fθ lens 20, the reflection mirror 21 and the relay lens 22, in order, as shown by a dash and dot line A. Accordingly, the laser beam is irradiated to the surface of a photosensitive drum 27 of the process cartridge 17.

The process cartridge 17 comprises the photosensitive drum 27, a scorotron type charger 29, a developing roller 31, a toner supply roller 33, a toner box 34, a transfer roller 30, a cleaning roller 51 and a secondary roller 52. The photosensitive drum 27 is rotatably arranged at a side of the developing roller 31 so that a rotational shaft of the photosensitive drum 27 is parallel to the rotational shaft of the developing roller 31. The photosensitive drum 27 is rotated in a counterclockwise direction shown by an arrow in FIG. 2, with contact with the developing roller 31. The rotational speed of the photosensitive drum 27 is different from that of the developing roller 31 so that there is a rotational speed difference between the photosensitive drum 27 and the developing roller 31. Due to the rotational speed difference, the load for rotating the developing roller 31 and the photosensitive roller 27 is increased.

A charge generation layer and a charge transporting layer are laminated on a conductive substrate to form the photosensitive drum 27. An organic beam electric conductive body, such as an azo pigment or a phthalocyanine pigment, is dispersed in a binder resin as a charge generation material to form the charge generation layer. A compound, such as a hydrazone type or an aryl amine type, is mixed in a resin, such as polycarbonate, to form the charge transporting layer.

The scorotron type charger 29 is arranged above and apart from the photosensitive drum 27 by a predetermined space therebetween so as not to contact the photosensitive drum 27. The scorotron type charger 29 is for positive charging. In the positive charging, corona discharge is generated from a discharge wire made of tungsten. The scorotron type charger 29 positively charges the surface of the photosensitive drum 27 uniformly.

When the photosensitive drum 27 is irradiated by the laser beam, a charge is generated in the charge generation layer by light absorption and the charge is transported to the surface of the photosensitive drum 27 by the charge transporting layer. The charge transported by the charge transporting layer nullifies the surface potential that is charged by the scorotron type charger 29. Accordingly, a potential difference is generated between a potential of an irradiated portion and a potential of a non-irradiated portion. The potential difference forms an electrostatic latent image.

The developing roller 31 is arranged at a down stream side of the scorotron type charger 29 with respect to the rotational direction (a counterclockwise direction in FIG. 2) of the photosensitive drum 27. The developing roller 31 is rotatable in a clockwise direction as shown by an arrow in FIG. 2. The developing roller 31 is formed by covering a metal roller shaft with a roller portion of a conductive rubber material and a developing bias is applied to the developing roller 31 from a developing bias applying electric source (not shown).

The toner supply roller 33 is aligned with the developing roller 31 and is arranged rotatably at a position opposite to the photosensitive drum 27 with respect to the developing roller 31. The supply roller 33 is in contact with the developing roller 31 in a compressed condition. There is a speed difference between the rotational speed of the toner supply roller 33 and that of the developing roller 31.

The supply roller 33 is formed by covering a metal roller shaft with a roller portion of a conductive foaming material. Toner is charged by frictional force that is generated by the developing roller 31 and the toner supply roller 33. The toner box 34 is arranged near the toner supply roller 33 and stores therein toner that is supplied to the developing roller 31 via the toner supply roller 33.

In this embodiment, the positive charged non-magnetic one component polymerized toner is used as a developer. The toner is polymerized toner that is obtained by copolymerizing a polymerization monomer, such as styrene monomer, or an acrylic monomer, such as acryl acid, alkyl (C1–C4) acrylate, and alkyl (C1–C4) methaacrylate, by a known polymerization method such as suspension polymerization. A particle diameter of the polymerization toner is approximately 6–10 μm. A coloring agent, such as carbon black or wax, is mixed with the polymerization toner and an additive, such as silica, is added to the polymerization toner for improving fluidity.

An agitator 36 is supported by a rotational shaft 35 and is rotatably arranged at a center of the toner box 34. When the agitator 36 is rotated in a counterclockwise direction, shown by an arrow in FIG. 2, the toner in the toner box 34 is agitated and fed toward the toner supply roller. A window 38 is arranged on a side wall of the toner box 34 for detecting the remaining amount of toner. The window 38 is cleaned by a cleaner 39 that is supported by the rotational shaft 35.

The transfer roller 30 is arranged at a lower stream side from the developing roller 31 and at a lower side of the photosensitive drum 27 with respect to the rotational direction of the photosensitive drum 27. The transfer roller 30 is supported rotatably in a clockwise direction shown by an arrow in FIG. 2. The transfer roller 30 is formed by covering a metal roller shaft with a roller of an ion conductive rubber material. Transfer bias is applied to the transfer roller 30 from the transfer bias applying electric source during a transfer operation.

The cleaning roller 51 is arranged near the photosensitive drum 27. The cleaning roller 51 is positioned at a downstream side from the transfer roller 30 and an upstream side from the scrotron type charger 29 with respect to the rotational direction of the photosensitive drum 27. A secondary roller 52 is arranged at an opposite side of the cleaning roller 51 from the photosensitive drum 27, which is positioned therebetween, so as to contact the cleaning roller 51. A wiping member 53 contacts the secondary roller 52.

The photosensitive drum 27 of the laser printer 1 is cleaned by a cleanerless method described below. After toner is transferred from the photosensitive drum 27 to a paper 3, the toner or the paper powder remaining on the surface of the photosensitive drum 27 is electrically attracted by the cleaning roller 51. Only the paper powder that is electrically attracted by the cleaning roller 51 is electrically attracted to the secondary roller 52. The paper powder attracted by the secondary roller 52 is wiped by the wiping member 53. The toner that is attracted by the cleaning roller 51 is returned to the photosensitive drum 27 and collected by the developing roller 31.

In the process cartridge 17, an exposure window 69 is arranged above the photosensitive drum 27 so that the laser beam from the scanner unit 16 is irradiated to the photosensitive drum 27. The exposure window 69 is arranged on an upper surface of a case 40 of the process cartridge 17 and at the toner box 34 side from the opening 171 of the scorotron type charger 29. The photosensitive drum 27 communicates with outside of the process cartridge 17 via the exposure window 69.

As shown in FIG. 3, the drive shaft 27*a* of the photosensitive drum 27 extends from the left and right sides of the case 40. A transfer gear 27*b* is fixed to the drive shaft 27*a*. A gear surface of the transfer gear 27*b* is partially exposed on one side of the case 40. A small gear portion 112*a* (FIG. 4) of a drum drive gear 112, that is interlocked with the transfer gear 27*b*, is exposed to the cartridge accommodation portion 57 (FIG. 1).

A guide plate 60 is arranged in the vicinity of the drive shaft 27*a* in the case 40 of the process cartridge 17. When the process cartridge 17 is mounted in the casing 2, the drive shaft 27*a* and the guide plate 60 are engaged to a guide groove that is formed in the casing 2. Accordingly, the process cartridge 17 is smoothly mounted in and removed from the casing 2.

A driving force input portion 70 is arranged almost centrally on a side surface of the case 40 of the process cartridge 17 where the transfer gear 27*b* is arranged. A cylindrical shaft receiving member 70*a* is formed in the driving force input portion 70. Two projections are arranged on an inner wall of the shaft receiving member 70*a* so as to be extended toward the center shaft and to face each other. The side surface where the driving force input portion 70 is arranged is a right side surface with respect to the insertion direction of the process cartridge 17 into the casing 2.

As shown in FIG. 2, the fixing device 18 is arranged at a lower stream side of the process cartridge 17. The fixing device 18 comprises a heat roller 41, a pressure roller 42 for pressing the heat roller 41, and a pair of transporting rollers 43 arranged at a downstream side of the heat roller 41 and the pressure roller 42. The heat roller 41 is made of a cylindrical metal roller and has a halogen lamp in the roller as a heating source.

Toner that is transferred to a paper 3 in the process cartridge 17 is melted by the heat and pressed and fixed onto the paper 3 when the paper 3 passes between the heat roller 41 and the pressure roller 42. Afterwards, the paper 3 is transported to the paper discharge path 44 by the transporting roller 43.

Figure 4:
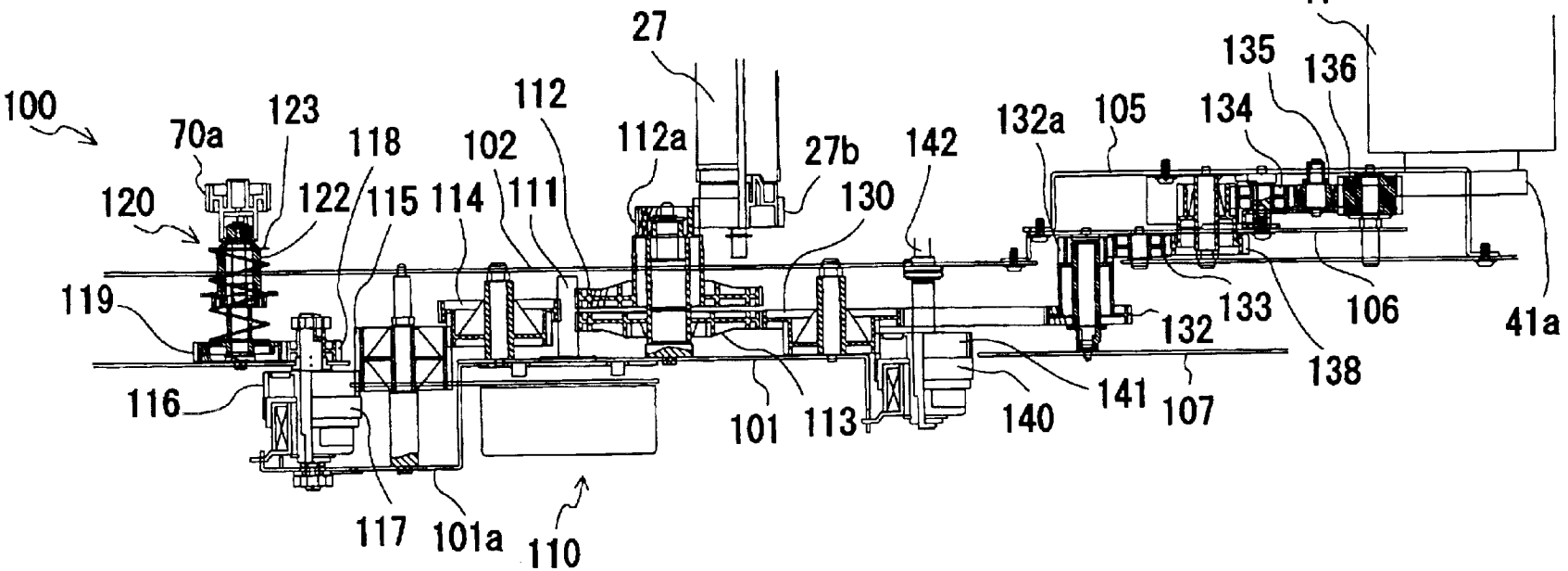
FIG. 4 is a horizontal cross sectional view of a driving mechanism of the laser printer.
Figure 5:
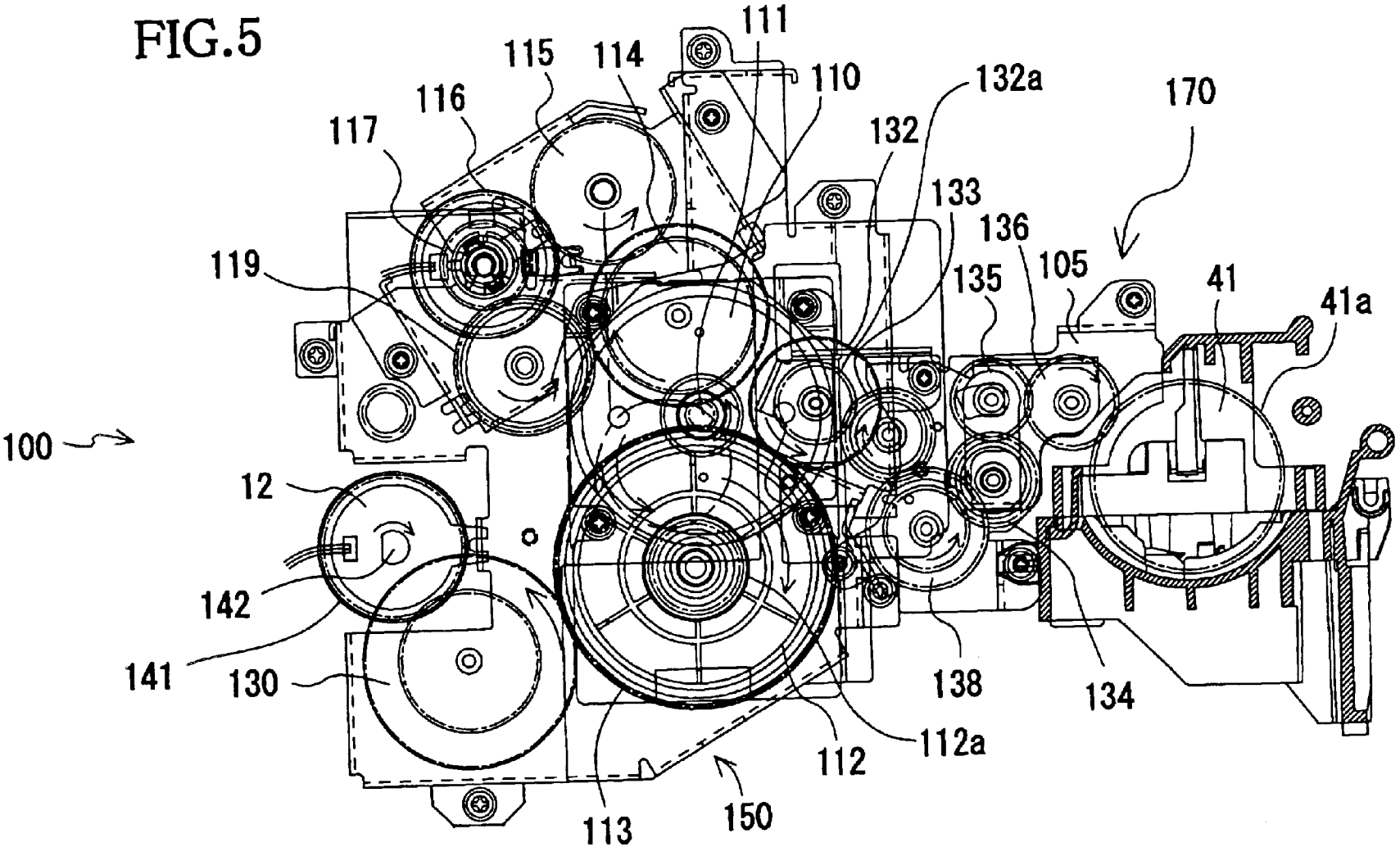
FIG. 5 is a view of the driving mechanism of FIG. 4 seen from the side.

The driving mechanism 100 of the laser printer 1 will be explained with reference to FIGS. 4 and 5. FIG. 4 is a horizontal cross sectional view of the driving mechanism 100 of the laser printer 1 and FIG. 5 is a view of the driving mechanism 100 shown in FIG. 4 seen from the left side.

As shown in FIG. 4, a gear tooth is integrally formed with a drive shaft 111 of a DC brushless motor 110. A drum drive gear 112 for driving the photosensitive drum 27, a thin gear 113 and a first idle gear 114 are interlocked with the drive shaft 111. The thin gear 113 is arranged on the same shaft as the drum drive gear 112.

The drive shaft 11 is made of stainless steel. The drum drive gear 112 and the thin gear 113 and a first idle gear 114 are arranged symmetrically with respect to the drive shaft 111. The drum drive gear 112, the thin gear 113 and the first idle gear 114 are interlocked with the drive shaft 111 and are helical tooth gears, i.e., the gear tooth thereof is not symmetrical with respect to a line perpendicular to the rotational shaft of each gear. Thus, each gear is rotated only in one direction, and only one side of the gear tooth is necessarily formed with certain precision. Accordingly, the manufacturing cost of the gears is decreased.

A second idle gear 115 is interlocked with the first idle gear 114. A third idle gear 116 is interlocked with the second idle gear 115. An electromagnetic clutch 117 is arranged on the third idle gear 116 and the third idle gear 116 is connected to the fourth idle gear 118 via the electromagnetic clutch 117. The fourth idle gear 118 is interlocked with an input gear 119.

When the third idle gear 116 is rotated with the electromagnetic clutch 117 being in a connected condition, the fourth idle gear 118 is rotated and the input gear 119 is rotated. A driving force input portion 120 is arranged at the distal end of the rotational shaft of the input gear 119.

An input terminal 122, that is urged by a spring 123 into an engagement position, is arranged at the distal end of the driving force input portion 120. As shown in FIG. 4, the input terminal 122 is detachably fitted to a shaft receiving member 70*a* that is arranged on the process cartridge 17.

When the input gear 119 is rotated during the fitted condition, the input terminal 122 transfers the driving force to the driving force input portion 70, shown in FIG. 3, to drive the developing roller 31, the supply roller 33 and the agitator 36.

U.S. patent application Ser. No. 10/397,371, filed concurrently and identified by Attorney Reference No. 115213, having the same application date as the Japanese Priority Patent Application for the instant U.S. Patent Application, discloses the structure of the process cartridge 17 wherein the driving force that is transferred to the driving force input portion 70 drives the developing roller 31, the supply roller 33 and the agitator 36. The disclosure of U.S. patent application No. 10/397,371, filed concurrently and identified by Attorney Reference No. 115213, is incorporated by reference herein in its entity.

The drum drive gear 112 is a two stage gear and includes a small gear portion 112*a*. Because the diameter of the small gear portion 112*a* is smaller than that of the drum drive gear 112, the small gear portion 112*a* rotates at slower rotational speed than the drum drive gear 112. The small gear portion 112*a* is interlocked with the transfer gear 27*b* that is formed at the end of the photosensitive drum 27. Therefore, when the drum drive gear 112 is rotated, the photosensitive drum 27 rotates.

The thin gear 113 is arranged on the same shaft as the drum drive gear 112. However, it is independently rotatable. A fifth idle gear 130 is also interlocked with the thin gear 113. The fifth idle gear 130 is interlocked with a sixth idle gear 141. An electromagnetic clutch 140 is arranged on the sixth idle gear 141. The driving of the sixth idle gear 141 is transferred to a rotational shaft 142 of the resist roller 12 via the electromagnetic clutch 140.

The driving mechanism 100 comprises a first frame 101, an upper first frame 101*a* (FIG. 6) and a second frame 102. The first frame 101, the upper first frame 101*a* and the second frame 102 are flat plates and arranged parallel to each other. One end of the rotational shaft of each of the above described gears is supported by one of the three frames and the other end of each rotational shaft is supported by a frame that faces the frame that supports the one end of the rotational shaft. That is, because the two ends of the rotational shaft of each gear are supported, the rotational shaft is prevented from becoming slanted.

With reference to FIGS. 4 and 5, the gear mechanism for rotating the heat roller 41 of the fixing device 18 will be explained. As shown in FIG. 4, the rotation of the thin gear 113 is transferred to a seventh idle gear 132 that is supported between a fourth frame 106 and a fifth frame 107. The thin gear 113 and the seventh idle gear 132 appear not to be interlocked with each other, as shown in FIG. 4, however, they are actually interlocked with each other as shown in FIG. 5. The seventh idle gear 132 is a two stage gear and a small gear 132*a* is integrally formed with the rotational shaft of the seventh idle gear 132. An eighth idle gear 133 is interlocked with the small gear 132*a*.

A ninth idle gear 138 is interlocked with the eighth idle gear 133. A tenth idle gear 134 is interlocked with the ninth idle gear 138. An eleventh idle gear 135 is interlocked with the tenth idle gear 134. A twelfth idle gear 136 is interlocked with the eleventh idle gear 135. A heat roller gear 41*a*, that is arranged at the end of the heat roller 41 of the fixing device 18, is interlocked with the twelfth idle gear 136.

Figure 6:
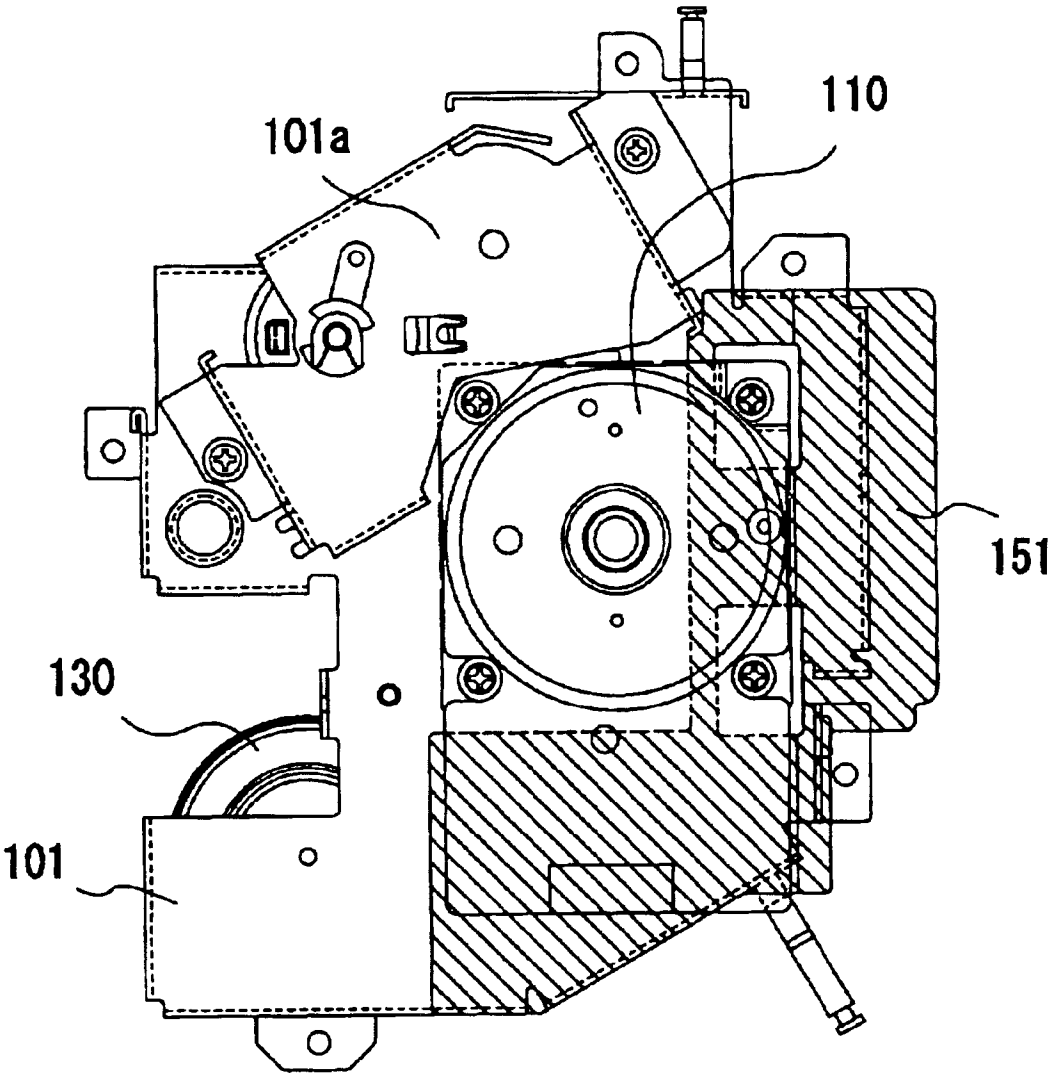
FIG. 6 is a plane view of a main gear unit as viewed in the same direction as in FIG. 5.
Figure 7:
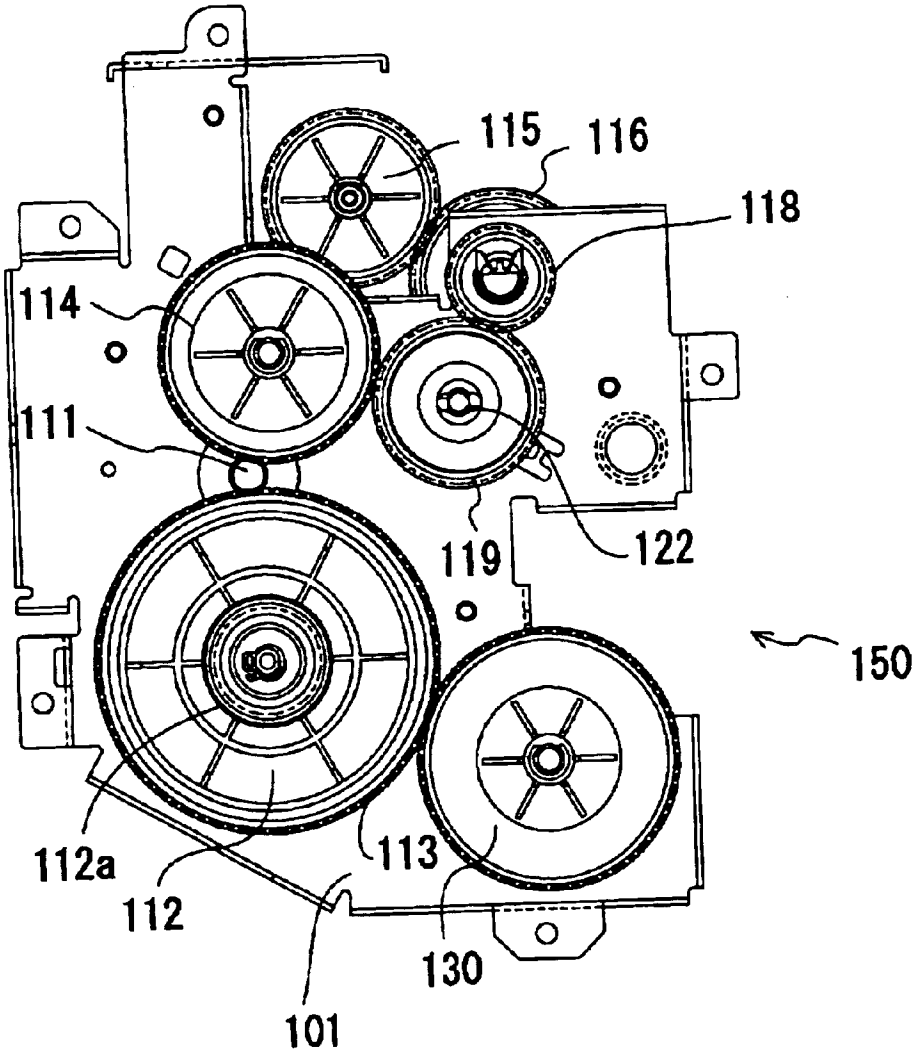
FIG. 7 is a view seen from a rear side in FIG. 6.

The structure of a main gear unit 150 will be explained with reference to FIGS. 6 and 7. The main gear unit 150 is a part of the driving mechanism 100 shown in FIG. 5. FIG. 6 is a view of the main gear unit 150 seen from the same side as FIG. 5. FIG. 7 is a view showing the main gear unit 150 of FIG. 6 seen from the rear side or inner case 2 sides.

As shown in FIG. 6, the main gear unit 150 comprises the first frame 101 and the upper first frame 101*a* that is fixed to the first frame 101 with screws. The first frame 101 and the upper first frame 101*a* are formed by cutting a metal plate into a predetermined shape and bent.

The DC brushless motor 110 is arranged at a center of the first frame 101. An insulating member 151, formed of a resin film, is arranged on a part of the first frame 101 as shown by shading in FIG. 6. A harness (not shown) is arranged on the insulating member 151. Therefore, even if the harness rubs against the insulating member 151 and is damaged, the harness is not electrically shorted.

As shown in FIG. 7, the drum drive gear 112 and the idle gear 114 are arranged on the rear side of the main gear unit 150 so as to be symmetrical with respect to the drive shaft 111 of the DC brushless motor 110. This arrangement prevents a force that could slant the drive shaft 111 in one direction from affecting the drive shaft 111.

Only the transfer gear 27*b*, that is interlocked with the small gear portion 112*a*, is connected to the drum drive gear 112, that is interlocked with the drive shaft 111 of the motor 110. The rotation of the drum drive gear 112 is transferred only to the photosensitive drum 27 and not transferred to other loads. Therefore, the drum drive gear 112 is not influenced by the other loads and the driving force from the drive shaft 111 of the DC brushless motor 110 is stably converted to the rotation of the photosensitive drum 27. Accordingly, the photosensitive drum 27 is rotated stably and images of high quality are obtained.

Because the line length of a line connecting a position where the drum drive gear 112 is interlocked with the drive shaft 111 and a position where the idle gear 114 is interlocked with the drive shaft 111 is almost equal to the diameter of the drive shaft 111, no unnecessary moment is applied to the drive shaft 111.

Figure 8:
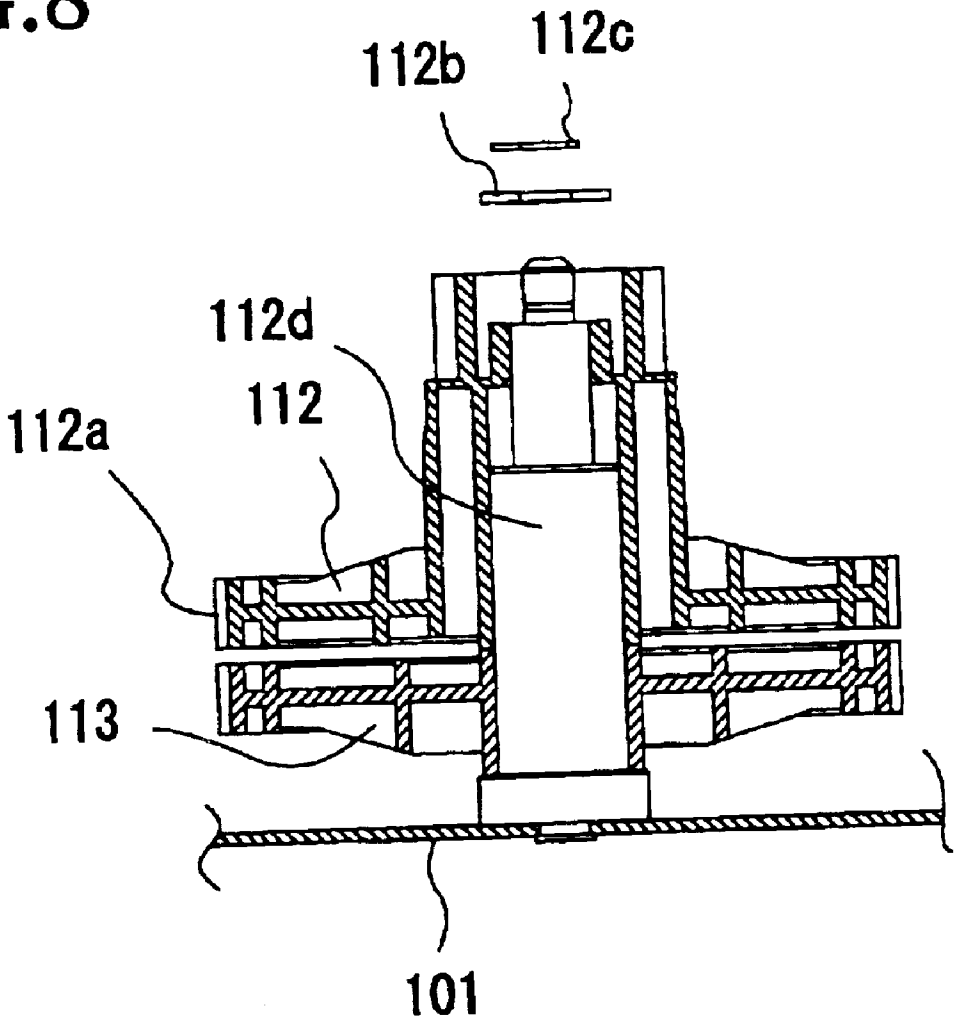
FIG. 8 is a cross sectional view of a drum driving gear and a thin gear.

The structure of the drum drive gear 112 and the thin gear 113 will be explained with reference to FIG. 8. FIG. 8 is a cross sectional view of the drum drive gear 112 and the thin gear 113. The drum drive gear 112 and the thin gear 113 are made of polyphenylene sulfaide resin. The drum drive gear 112 and the thin gear 113 are supported by a shaft 112*d*, that extends from the first frame 101, so as to be rotatable independently of each other and are fixed by a washer 112*b* and a snap ring 112*c*.

As described above, the drum drive gear 112 transfers the driving force only to the photosensitive drum 27 and the thin gear 113 transfers the driving force only to the resist roller 12. Because the gears that transfer the driving force to different loads are arranged on the same shaft, the space required is small.

Figure 9:
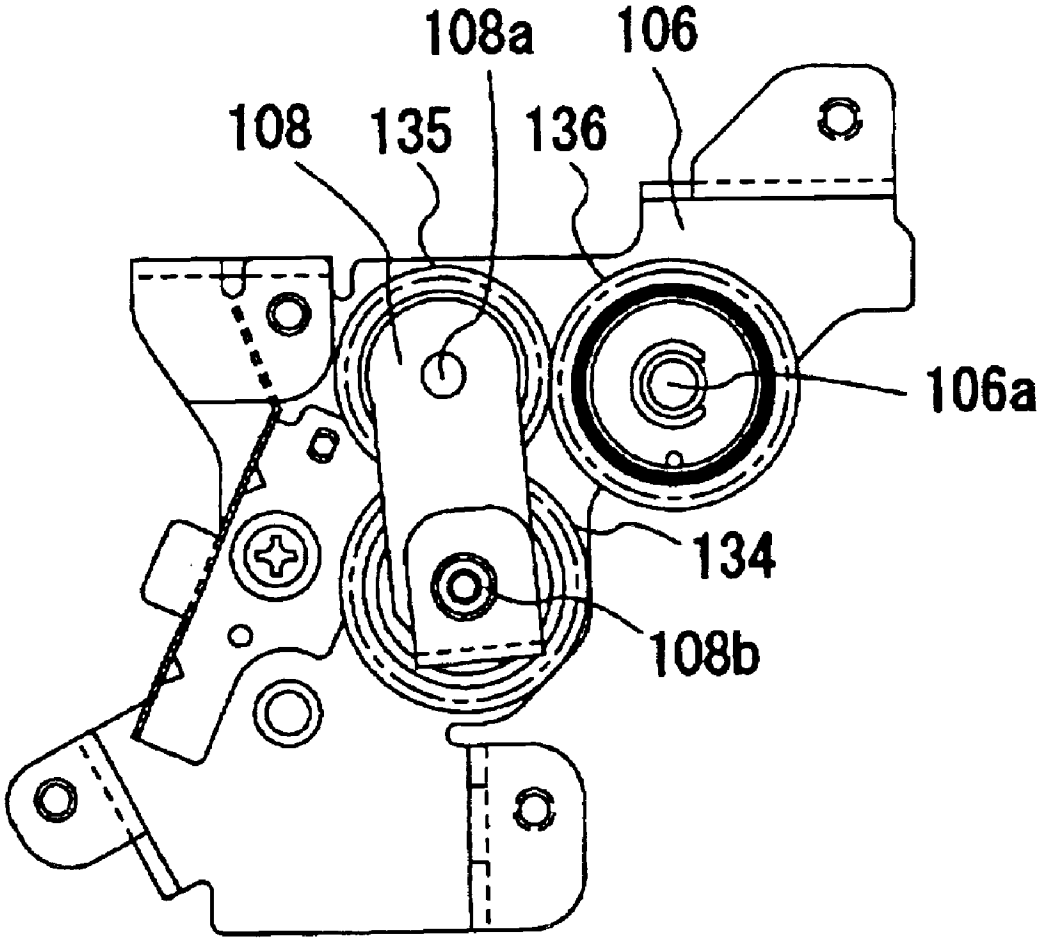
FIG. 9 is a view of a portion of a discharge gear unit that is arranged in the driving mechanism shown in FIG. 5.
Figure 10:
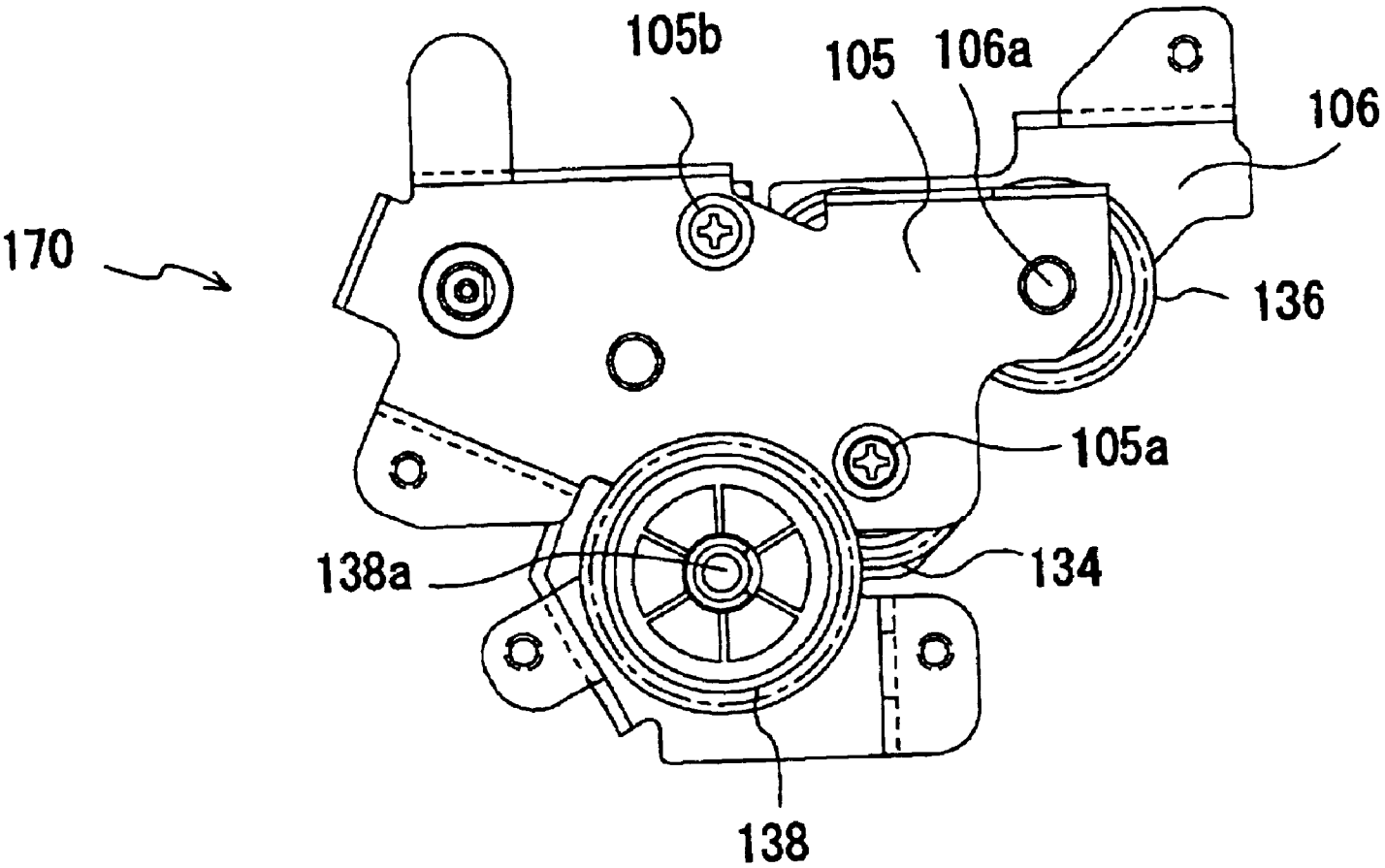
FIG. 10 is a view of the discharge gear unit shown in FIG. 9.

The structure of a discharge gear unit 170 for transferring the driving force to the heat roller 41 will be explained with reference to FIGS. 9 and 10. FIGS. 9 and 10 are views of the discharge gear unit that is arranged in the driving mechanism 100 as shown in FIG. 5.

As shown in FIG. 10, the third frame 105 and the fourth frame 106 are arranged in the discharge gear unit 170 so as to be parallel to each other. The tenth idle gear 134, the eleventh idle gear 135 and the twelfth idle gear 136 are supported by shafts between the third frame 105 and the fourth frame 106. As shown in FIG. 9, a support shaft 108*a* and a hollow support shaft 108*b* are arranged between the fourth frame 106 and the subframe 108. The tenth idle gear 134 is supported by the hollow support shaft 108*b*.

The support shafts 108*a*, 108*b* are supported so that the two ends of each support shaft 108*a*, 108*b* are supported by the fourth frame 106 and the subframe 108. The support shaft 106*a* is supported so that its two ends are supported by the third frame 105 and the fourth frame 106. Therefore, the support shafts 106*a*, 108*a*, 108*b* are prevented from being slanted. A support shaft 138*a* extends from the fourth frame 106 to support the ninth idle gear 138.

Figure 11:
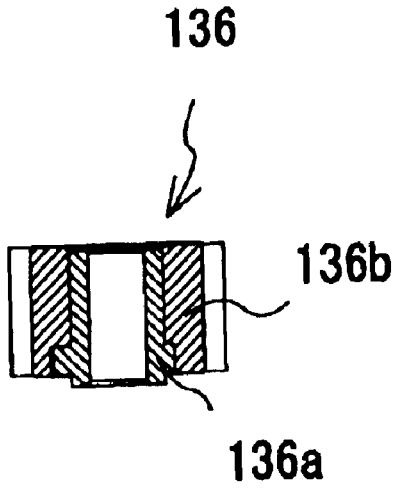
FIG. 11 is a central cross-sectional view of a twelfth idle gear.
Figure 12:
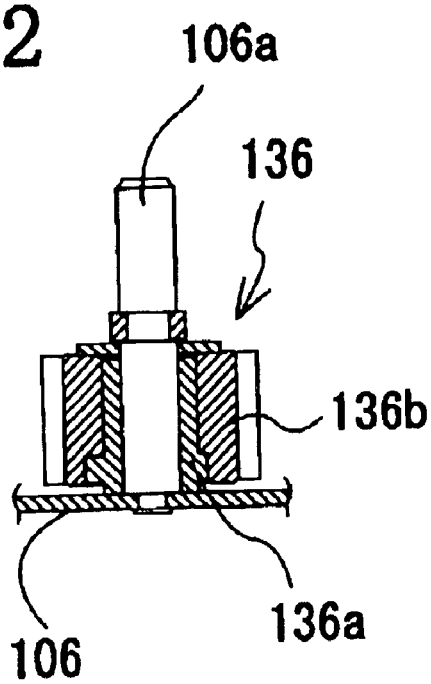
FIG. 12 is a view showing the twelfth idle gear is mounted in a fourth frame.

The structure of the twelfth idle gear 136 will be explained with reference to FIGS. 11 and 12. FIG. 11 is a central cross sectional view of the twelfth idle gear 136 and FIG. 12 is a view showing that the twelfth idle gear 136 fitted to the support shaft 106*a* that is arranged on the fourth frame 106.

The twelfth idle gear 136 is interlocked with the heat roller gear 41*a* that is arranged at the end of the heat roller 41 so as to transfer the power for rotating the heat roller 41. When the halogen lamp is turned on, the heat roller 41 has high temperature of 170° C. and the twelfth idle gear 136 is subjected to the heat. Therefore, the twelfth idle gear 136 must be heat resistant.

The shaft receiving member 136*a* rotatably received on the support shaft 106*a* is formed of polyphenylene sulfaide resin having superior heat resistance, and the metal tooth member 136*b* arranged around the shaft receiving member 136*a* is made by sintering iron or copper powder.

As explained above, in the laser printer 1 of this embodiment, the drum drive gear 112, that drives the photosensitive drum 27, is interlocked with the drive shaft 111 of the DC brushless motor 110 and the drum drive gear 112 does not transfer the driving force to loads other than the photosensitive drum 27. Accordingly, the photosensitive drum 27 is not influenced by the other loads and rotates stably. Therefore, images of high quality can be obtained.

The developing roller 31 and the supply roller 33 rotate in contact with each other with a rotational speed difference between the developing roller 31 and the supply roller 33. Therefore, when the developing roller 31 and the supply roller 33 rotate, a large load is generated. However, the load fluctuation is not transferred to the drum drive gear 112 and the photosensitive drum 27 rotates stably.

When a paper 3 is supplied to the resist roller 12 or the heat roller 41, the load applied to the resist roller 12 or the heat roller 41 is increased compared to before the paper 3 is so supplied. However, because the load fluctuation is not transferred to the drum drive gear 112, the photosensitive drum 27 rotates stably.

Although the described invention has been described in detail and with reference to a specific embodiment thereof, it would be apparent to those skilled in the art that various changes, arrangements and modifications may be applied therein without departing from the spirit and scope of the invention.

In the embodiment, a tooth is formed by cutting the drive shaft 111 of the DC brushless motor 110 to obtain a gear, however, another gear may be fixed to the drive shaft 111. Further, in the embodiment, the small gear portion 112*a* of the drum drive gear 112 directly drives the transfer gear 27*b*, that is formed at the end of the photosensitive drum 27, to rotate the photosensitive drum 27. However, another driving force transferring mechanism may be arranged between the small gear portion 112*a* and the transfer gear 27*b*.

What is claimed is:

1. An image forming apparatus, comprising:

a driving source that outputs a driving force;

an image holding member that holds an image thereon;

a first transmission mechanism that communicates the driving force to the image holding member; and a second transmission mechanism that communicates the driving force with a load different from the image holding member, the first transmission mechanism being independent from the second transmission mechanism, wherein the driving source drives a gear, the first transmission mechanism includes a first gear that communicates with the image holding member, and the second transmission mechanism includes a second gear that communicates with the load, the first gear and the second gear are provided at a common axis and independently rotatable so that the first gear and the second gear engage the gear of the driving source.

2. The image forming apparatus according to claim 1, wherein the driving source is a motor with a rotating shaft, the gear being formed with the rotating shaft, and both the first gear of the first transmission mechanism and the second gear of the second transmission mechanism engage with the gear of the motor.

3. The image forming apparatus according to claim 2, wherein the first gear and the second gear are positioned such that an engaging position of the first gear with the gear of the motor is adjacent with an engaging position of the second gear with the gear of the motor about the shaft of the motor.

4. The image forming apparatus according to claim 1, further comprises a third transmission mechanism including a third gear that communicates with the gear of the driving source and another load, the third transmission mechanism being independent from each of the first transmission mechanism and the second transmission mechanism, the first gear and the third gear are positioned such that an engaging position of the first gear with the gear of the driving source is symmetrical with an engaging position of the third gear with the gear of the driving source about a shaft of the driving source.

5. The image forming apparatus according to claim 4, wherein the second transmission mechanism communicates with a paper feed roller and a heat roller.

6. The image forming apparatus according to claim 5, wherein the third transmission mechanism communicates with a developing roller that holds and supplies a developing agent to the image holding member.

7. The image forming apparatus according to claim 6, wherein the first transmission mechanism and the third transmission mechanism are formed such that the image holding member is driven in a different peripheral speed than the developing roller.

8. The image forming apparatus according to claim 6, wherein the third transmission mechanism communicates with a supplying roller that supplies the developing agent to the developing roller.

9. The image forming apparatus according to claim 6, wherein the third transmission mechanism is formed such that the supplying roller is driven at a different peripheral speed than the developing roller.

10. The image forming apparatus according to claim 4, wherein each of the first gear, the second gear and third gear is a helical gear.

11. The image forming apparatus according to claim 5, wherein a heat roller gear is provided at the heat roller, the heat roller gear communicating with the second transmission mechanism, wherein the heat roller gear is formed with a core shaft of heat-resistance resin and metal teeth around the core shaft.

12. A drive mechanism, for use in a printing device having a photosensitive drum, a toner feed device, and a beating mechanism, comprising:

a drive motor;

a first drive train;

a second drive train; and a third drive train, wherein the drive motor has a drive shaft with a drive gear, the first drive train and the second drive train each have a first drive element independently rotatable but adjacent to one another on a common shaft and engaged with the drive gear, and a first drive element of the third drive train is substantially symmetrically opposed to the first drive element of each of the first drive train and the second drive train with the drive gear therebetween.

13. The drive mechanism according to claim 12, wherein the first drive elements of the first, second and third drive trains are helical gears.

14. The drive mechanism according to claim 12, wherein the first drive train drives the photosensitive drum, the second drive train drives the heating mechanism, and the third drive train drives the toner feed device.

15. The drive mechanism according to claim 14, wherein the first drive element of the first drive train is a two stage gear, a large gear stage engaged with the drive gear and a small gear stage engaged with the photosensitive drum.

16. The drive mechanism according to claim 14, wherein the arrangement of the first drive element of the first, second and third drive trains counterbalance forces applied to the drive shaft of the motor through the drive gear.

17. The drive mechanism according to claim 12, wherein the drive gear is formed in the drive shaft.

18. The drive mechanism according to claim 12, wherein the drive gear is fixedly mounted to the drive shaft.

* * * * *